US005409168A

United States Patent [19]

Nelson et al.

[11] Patent Number: 5,409,168

[45] Date of Patent: Apr. 25, 1995

[54] POSITIVE LATCHING CAP FOR MODULAR SPRINKLER ASSEMBLY

[75] Inventors: Craig B. Nelson; Paul D. Davisson, both of Walla Walla, Wash.

[73] Assignee: Nelson Irrigation Corporation, Walla Walla, Wash.

[21] Appl. No.: 113,046

[22] Filed: Aug. 31, 1993

[51] Int. Cl.[6] ..... B05B 1/26; B05B 3/02

[52] U.S. Cl. ..... 239/222.17; 239/222.11; 239/252; 239/391; 239/396; 239/436; 239/505; 239/600

[58] Field of Search ..... 239/600, 222.11, 222.17, 239/390, 391, 246, 251, 252, 247, 396, 436, 505; 215/214, 216, 217, 222

[56] References Cited

U.S. PATENT DOCUMENTS

| | | | |
|---|---|---|---|
| D. 312,865 | 12/1990 | Davisson | D23/214 |
| 2,711,925 | 6/1955 | King | 239/390 |
| 2,941,727 | 6/1960 | Zybach . | |
| 3,339,770 | 9/1967 | Weigand | 215/214 |
| 3,435,975 | 4/1969 | Weigand | 215/214 |
| 3,613,929 | 10/1971 | Treanor | 215/214 |
| 3,704,802 | 12/1972 | Schultz | 215/214 |
| 3,753,510 | 8/1973 | Hedgewick et al. | 215/214 |
| 3,880,314 | 4/1975 | Akers | 215/214 |
| 3,929,287 | 12/1975 | Givler et al. | 239/391 |
| 4,049,148 | 9/1977 | Suhr et al. | 215/214 |
| 4,053,078 | 10/1977 | Herr | 215/222 |
| 4,185,781 | 1/1980 | O'Brien | 239/600 |
| 4,399,921 | 8/1983 | Kusz | 215/214 |
| 4,405,085 | 9/1983 | Meyer | 239/726 |
| 4,410,097 | 10/1983 | Kusz | 215/214 |
| 4,434,937 | 3/1984 | Pitchford | 239/230 |
| 4,438,884 | 3/1984 | O'Brien et al. | 239/600 |
| 4,527,745 | 7/1985 | Butterfield et al. | 239/600 |
| 4,562,964 | 1/1986 | Diamond | 239/600 |
| 4,676,438 | 6/1987 | Sesser | 239/722 |
| 4,747,540 | 5/1988 | Meyer | 239/76 |
| 4,787,558 | 11/1988 | Sexton et al. | 239/205 |
| 4,796,811 | 1/1989 | Davisson | 239/222.17 |
| 4,819,875 | 4/1989 | Beal | 239/97 |
| 5,145,080 | 9/1992 | Imberry, Jr. | 215/216 X |

FOREIGN PATENT DOCUMENTS

| | | | |
|---|---|---|---|
| 0208390 | 1/1987 | European Pat. Off. . | |
| 1161323 | 8/1969 | United Kingdom | 215/222 |
| 1302202 | 1/1973 | United Kingdom | 215/222 |
| 1098574 | 6/1984 | U.S.S.R. | 239/390 |

OTHER PUBLICATIONS

"Nelson Pivot rotator TM : R30 and R300 Series Rotators; S30 and S300 Series Spinners." Nelson Irrigation Corporation, Feb. 1992.

"Nelson 3000 Series Modular Sprinkler for Pivots." Nelson Irrigation Corporation, Sep. 1992.

*Primary Examiner*—Andres Kashnikow
*Assistant Examiner*—Lesley D. Morris
*Attorney, Agent, or Firm*—Nixon & Vanderhye

[57] ABSTRACT

A modular sprinkler assembly includes a sprinkler body having an annular cap supporting ring and a nozzle for emitting a liquid stream to atmosphere. A cap assembly is removably secured to the cap supporting ring, the cap assembly including a stream distributor. The cap is formed with a top wall and an annular depending skirt, an interior surface of the skirt having at least one latch device formed thereon. The latch device includes a wedge-shaped surface portion and a land portion, and the cap supporting ring has at least one radially extending tab adapted to ride on the wedge-shaped surface portion and to seat on the land portion upon rotation of the cap relative to the sprinkler body. The cap assembly may support a pair of differently configured stream distributors facing in opposite directions, and in this cap construction, the cap is reversible, i.e., the cap can be inverted and reattached to the sprinkler body to take advantage of the additional stream distributor.

18 Claims, 7 Drawing Sheets

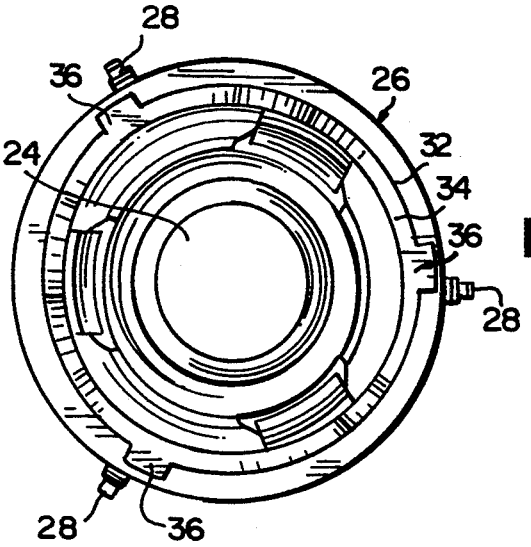
FIG. 3
FIG. 4
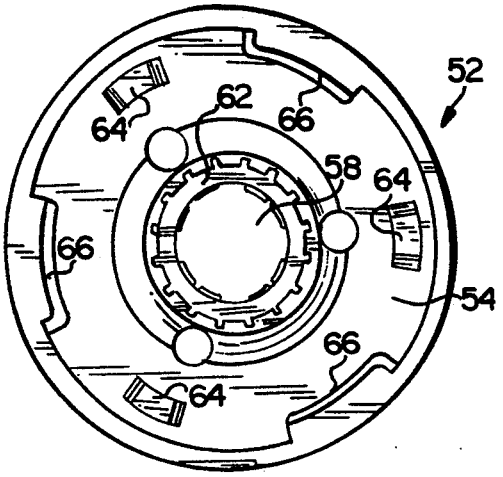
FIG. 5
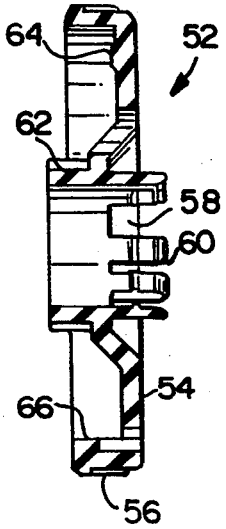
FIG. 6
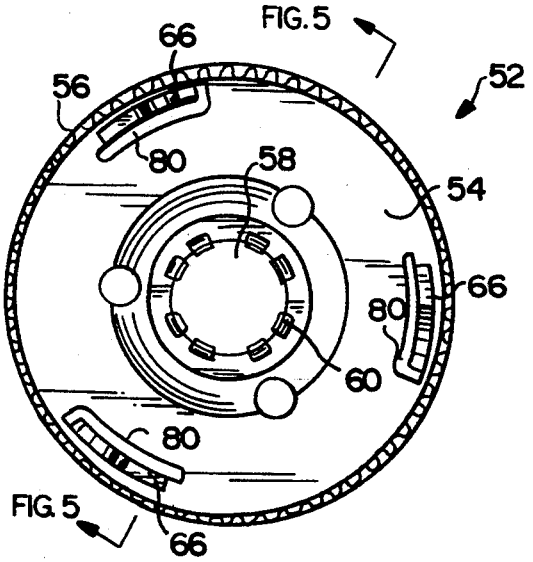

POSITIVE LATCHING CAP FOR MODULAR SPRINKLER ASSEMBLY

BACKGROUND AND SUMMARY OF THE INVENTION

This invention relates to modular sprinkler devices and, more specifically, the invention relates to an improved positive latching cap for a modular sprinkler which prevents separation of the cap (and sprinkler components attached thereto) from the sprinkler body during use.

Moving irrigation systems, such as conventional pivot move and lateral move systems, are known to incorporate conduit truss span assemblies at a plurality of drop tubes by which a corresponding number of spray heads incorporating rotatable distributors (also referred to as rotor plates or spinners), fixed spray plates, or bubbler devices are suspended so as to be located in close proximity to crops or other plants.

There is currently in use a modular spray head which includes a sprinkler body and a cap assembly including a stream distributor (for example, a rotor plate or a fixed spray head) which is designed for quick assembly and disassembly from the sprinkler body. The cap assembly is secured to the sprinkler body by a conventional screw thread arrangement in combination with a locking mechanism where a plurality of vertically extending projections on the cap (extending from the cap surface by no more than about 1/16 inch) engage a corresponding plurality of notches formed on the cap mounting ring when the cap reaches the full extent of its rotational movement relative to the body during threading. To disassemble the cap, the latter is simply rotated counterclockwise with sufficient force to disengage the projections from the notches.

The above described prior arrangement may experience problems in the field, however, by reason of the detachment of the cap and rotor plate (or fixed spray plate) from the sprinkler body, rendering the spray head substantially inoperative. The detachment problem is caused by brushing engagement of the spray head with crops (such as corn stalks) as the system moves through a field. As a result, the known locking mechanism is insufficient to withstand the rigors of use in its intended environment. Similar detachment problems may be experienced with the sprinkler devices associated with known drag socks and drag hoses which are pulled along the ground.

An improved locking arrangement between a cap assembly and a sprinkler body is disclosed in commonly owned U.S. Pat. No. 5,224,653. In that application, the sprinkler body is formed with an upwardly extending frusto-conical portion which supports, by way of three equally circumferentially spaced posts, an annular cap mounting ring. This ring has a substantially vertical exterior surface formed with a plurality of discontinuous thread ramps separated by a plurality of circumferentially spaced gaps. Each ramp extends circumferentially from its free or starting end partially about the circumference of the ring and downwardly to a termination point defined by one of the respective posts. The interior of the annular ring, also formed as a vertical surface, is formed with a plurality of equally circumferentially spaced wedge-shaped detents which are adapted to cooperate with a mating latching element formed on the cap.

The cap portion of the sprinkler assembly is generally circular in shape and includes a top wall and an outer depending skirt portion. The top wall is provided with a centrally located aperture for supporting a rotor plate. The outer annular surface of the skirt is provided at its lower edge with three, equally circumferentially spaced, radially inwardly directed tabs which are adapted to pass simultaneously through the correspondingly located gaps between the thread ramps on the annular mounting ring. The cap is placed on the ring with the components oriented so that the tabs are aligned with the gaps. Once the tabs have been pushed downward through the gaps, clockwise rotation of the cap will cause the latter to be pulled downwardly onto the mounting ring by the thread ramps.

The cap is also formed with a radial thumb press which includes a pushbutton extending radially outwardly from the cap skirt and connected to the cap skirt by means of a pair of thin, circumferentially extending webs which provide the button with both radial and axial flexibility. The thumb press is integrally connected to a latching member which extends radially inwardly of the button and which is accommodated within a notch provided in the cap top wall. The underside of the latching member includes a wedge-shaped latching element which is substantially similar in shape to the wedge-shaped detents provided on the interior surface of the annular mounting ring.

The arrangement is such that after placement of the cap on the sprinkler body and upon clockwise rotation of the cap relative to the body, the wedge-shaped latching element will be resiliently biased upwardly and/or radially outwardly to allow the element to ride along the upper edge of the annular mounting ring. When the latching element finds the next adjacent wedge-shaped detent, it is resiliently pushed into the detent to thereby releasably lock the cap to the sprinkler body. The cap may be removed by pushing the thumb press button radially inwardly to release the latching element from the detent, thereby permitting counterclockwise rotation of the cap relative to the body.

In this invention, a further improved positive latching cap is provided which provides a secure connection between the cap and the sprinkler body, but which also permits quick and easy removal of the cap.

More specifically, the modular sprinkler in the exemplary embodiment includes a sprinkler body portion, a removable cap assembly, a quick change nozzle and an adapter for connecting the modular sprinkler to a drop tube, hose, or other conduit connected to a water source. The cap assembly include sa distribution plate or rotor plate (or a fixed spray head) which redirects a stream issuing from the nozzle in a substantially radial direction. The rotation of the rotor plate is controlled by a viscous fluid brake or dampener mechanism which is frictionally held within a centrally oriented hub portion of the cap assembly. The sprinkler body supports an annular cap mounting ring in a manner similar to that described in the '448 application, but the mounting ring, and the associated cap component of the cap assembly incorporate a new positive latching mechanism as described further herein.

The annular cap mounting ring of the sprinkler body includes a vertical wall having an upper edge and three radially outwardly projecting lugs or tabs which are contiguous with that upper edge. At centrally located positions between each of the radially outwardly projecting tabs, the cap mounting ring wall incorporates resilient spring areas, each of which is defined by an elongated slot formed in the wall. These spring areas extend slightly above the remaining portions of the upper edge of the wall. The resulting, relatively thin webs defined by the upper edge of the wall and by the elongated slots, are thus provided with a measure of resilient flexibility which allows them to act in the manner of spring in vertical directions.

The cap component of the cap assembly is formed with a top wall and an annular, depending skirt portion. The top wall is formed with a centrally located aperture through which the previously described viscous brake or dampener extends. The brake mechanism is frictionally held by a plurality of spring fingers which extend upwardly as part of a central hub sleeve in which the brake mechanism is received. The underside of the top wall of the cap component is provided with three equally spaced lugs which project downwardly toward the sprinkler body. In addition, the interior surface of the depending skirt is formed with three equally circumferentially spaced wedge locks which project radially inwardly and which also extend circumferentially. Each wedge lock includes a wedge-like ramp surface and a horizontal land which has a height slightly less than the uppermost point of the ramp surface.

In order to assemble the cap assembly to the sprinkler body, the cap assembly is positioned onto the body in such a way that the wedge locks are able to clear the tabs on the annular cap mounting ring. The cap assembly may then be rotated in a clockwise direction such that the tabs on the cap mounting ring pull the cap assembly downwardly by reason of the sliding engagement of the tabs relative to the wedge-like ramp surfaces of the wedge locks. As the cap assembly is pulled down, the projecting lugs on the underside of the top wall engage the raised portions of the resilient spring areas to, in effect, exert an upward bias on the cap assembly relative to the body portion. The cap assembly continues to be rotated until the tabs have passed over the uppermost edges of the respective wedge-like ramp surfaces, and have seated themselves in the land areas of the wedge locks. Because these land areas are at a height slightly less than the uppermost edges of the wedge-like ramp surfaces (thereby creating a step or shoulder), when the tabs seat in the lands, the resistive spring force exerted by the resilient spring areas on the cap assembly will be relieved. In this releasably locked position, the fully engaged seating between the tabs and the lands will prevent inadvertent or accidental disassembly of the cap assembly from the sprinkler body during use.

In order to remove the cap assembly, one need only press downwardly on the cap assembly relative to the body (and against the resistive force exerted by the resilient spring areas), so as to enable the tabs to clear the shoulders between the wedge-like ramp surfaces and the lands. This then enables the user to rotate the cap assembly in a counterclockwise direction until the positive latching device or wedge locks are moved to locations circumferentially spaced from the tabs. At this point, the user can simply lift the cap assembly upwardly away from the sprinkler body.

Thus, in accordance with one aspect of the invention, there is provided a modular sprinkler assembly comprising a sprinkler body including an annular cap supporting ring and a nozzle for emitting a liquid stream to atmosphere, and a cap assembly removably secured to the cap supporting ring, the cap assembly including a cap supporting a stream distributor, the cap having a top wall and an annular depending skirt, an interior surface of the skirt having at least one latch device formed thereon, the latch device including a wedge-shaped surface portion and a land portion, and wherein the cap supporting ring has at least one radially extending tab adapted to ride on the wedge-shaped surface portion and to seat on the land portion upon rotation of the cap relative to the sprinkler body.

In accordance with another aspect, the invention provides a modular sprinkler assembly comprising a sprinkler body having a nozzle therein for emitting a stream in a direction substantially coincident with a longitudinal axis of the sprinkler body, the sprinkler body also having a supporting ring located downstream of the nozzle; and a cap assembly removably secured on the mounting ring, the cap assembly including a cap having a top wall and a depending skirt, the top wall supporting at least one stream distributor in proximity to the nozzle; the mounting ring and the cap having first and second means, respectively, for removably securing the cap assembly to the mounting ring, the second means including at least one wedge lock extending partially about the mounting ring, the wedge lock including a wedge surface and an adjacent land for cooperating engagement with the first means.

In still another aspect, the invention provides a modular sprinkler assembly comprising a sprinkler body including a substantially vertical annular cap supporting ring and a nozzle for emitting a liquid stream to atmosphere; and a cap assembly removably secured to the cap supporting ring, the cap having a top wall and upper and lower skirt portions extending in opposite directions from the top wall, a first stream distributor mounted in said top wall and facing in one direction, and a second stream distributor mounted on the top wall and facing in a direction opposite to the one direction.

It will be appreciated from the above general description, that the positive latching cap assembly in accordance with this invention provides secure releasably locked engagement between the cap assembly and the sprinkler body portion, while at the same time, permitting easy removal of the cap assembly.

Other objects and advantages of the invention will become apparent from the detailed description which follows.

BRIEF DESCRIPTION OF THE DRAWINGS

FIG. 3 is a top plan view of the body portion of the sprinkler illustrated in FIG. 2;

FIG. 4 is a bottom plan view of the cap illustrated in FIG. 2;

FIG. 5 is a section view of the cap illustrated in FIG. 2, and taken along the line 5—5 of FIG. 6;

FIG. 6 is a top plan view of the cap illustrated in FIG. 2;

DETAILED DESCRIPTION OF THE DRAWINGS

Figure 1:
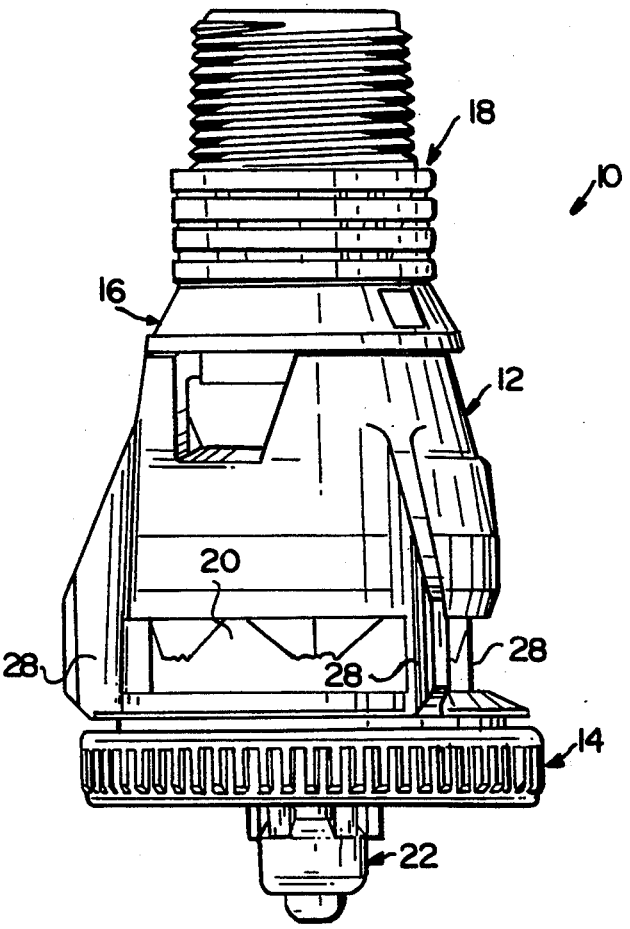
FIG. 1 is a side elevation of the modular sprinkler construction in accordance with the invention, shown in an inverted orientation typically employed in pivot and lateral move irrigation systems.
Figure 2:
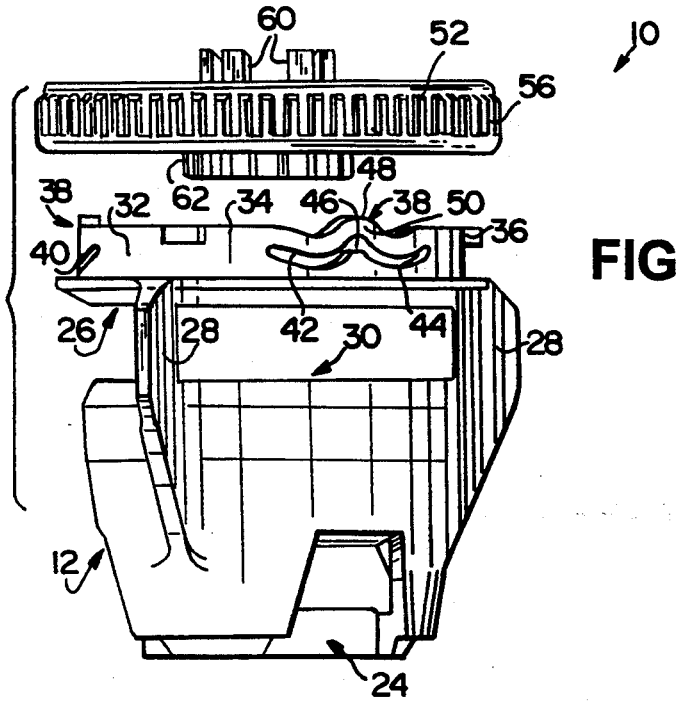
FIG. 2 is an exploded elevation of the sprinkler shown in FIG. 1, but in a normal upright orientation, and with component parts removed for clarity.

With reference to FIGS. 1 and 2, a modular sprinkler construction 10 is illustrated which incorporates a positive latch cap assembly in accordance with this invention. The sprinkler includes, generally, a body 12, a removable cap assembly 14, a quick change nozzle 16, and an adapter 18. The cap assembly 14 includes a stream distribution plate (also known as a rotor plate) 20 which redirects in a substantially radial direction a stream issuing from the stationary nozzle 16 by reason of the multi-groove, multi-surface configuration of the spinner. The various grooves and surfaces are designed to cause the rotor plate and its associated shaft (not shown) to rotate in a known manner about a vertical axis extending through the center of the sprinkler. The rotation of the rotor plate is controlled by a viscous fluid brake or dampener (also known as a rotor motor) mechanism 22 which is frictionally held within a centrally oriented hub portion of the cap assembly 14. The rotor plate and associated brake mechanism are of conventional construction as reflected in current sprinklers available from Nelson Irrigation Corp., and do not per se constitute a part of this invention. Reference is also made in this regard to commonly owned U.S. Pat. Nos. Re. 33, 823; 4,796,811 and Des. 312,865.

This invention relates specifically to a unique positive latch mechanism by which the cap assembly 14 is releasably secured to the sprinkler body 12.

With reference now especially to FIG. 2, the sprinkler body 12 includes an inlet portion 24 which receives the adapter 18 and the quick change nozzle 16. It will be understood that the adapter is to be connected to a drop tube, hose or other conduit ultimately connected to a source of water under pressure. An annular cap mounting ring 26 is supported by a plurality (three in the exemplary embodiment) of upstanding posts 28 in axially spaced relationship to the outlet end 30 of the sprinkler body 12 (and the nozzle 16 secured therein). The posts or webs 28 are equally spaced about the periphery of the sprinkler body 12 and, as can be best appreciated from FIG. 1, the circumferential gaps between the posts 28 provide the necessary spaces for permitting the stream to be thrown radially away from the sprinkler. As best seen in FIGS. 2 and 3, the annular cap mounting ring 26 includes a vertical wall 32 having an upper edge 34 and, in the exemplary embodiment, three radially outwardly projecting lugs or tabs 36 which are contiguous with the upper edge 34. At centrally located positions between each of the radially outwardly projecting tabs 36, the wall 32 incorporates resilient spring areas 38, each of which is created by the presence of an elongated slot 40 formed in the wall 32 and including a pair of curved upper edge 34 in this resilient spring area 38 is shaped to conform generally to the shape of the slot 40 and includes a raised apex 48 which extends slightly above the remaining portions of the upper edge 34. The resultant relatively thin web 50 (as defined by the upper edge 34 and the slot 40) is thus provided with a measure of resilient flexibility which allows it to act in the manner of a spring in vertical directions. The manner in which the resilient spring areas 38 interact with the cap assembly 14 will be described in greater detail hereinbelow.

With reference now to FIGS. 4 through 6, the cap component 52 of the cap assembly 14 is formed with a top wall 54 (FIGS. 5 and 6) and an annular depending skirt portions 56. The top wall 54 is formed with a centrally located aperture 58 through which the previously described viscous brake or dampener 22 extends, frictionally held by fingers 60 which extend upwardly as part of a centrally located sleeve 62.

With specific reference to FIG. 4, the underside of the top wall 54 of the cap 52 is provided with three equally spaced lugs 64 which project downwardly toward the sprinkler body (see also FIG. 5). In addition, the interior surface of the depending skirt 56 of the cap 52 is formed with three equally circumferentially spaced wedge locks 66 which project radially inwardly, and which also extend circumferentially as best seen in FIGS. 4, 5 and 7–13. With reference to, for example, FIG. 7, each wedge lock 66 includes a lower surface 68 which is flush with the lower edge of the cap skirt, a wedge-like ramp. surface 70, and a horizontal land 72 which has a height slightly less than the highest point 74 of the ramp surface 70, thus creating a shoulder 76 or step at the interface thereof. The land 72 is also defined in the circumferential direction by vertical surface 78.

The wedge locks 66 lie vertically beneath the elongated slots 80 formed in the top wall 54, as best seen in FIG. 6.

With reference now to FIGS. 7 through 10, the attachment of a cap assembly 14 to the sprinkler body 12 is illustrated sequentially, with the relevant elements of each component shown relatively to each other at each step of the sequence. For purposes of this description, it matters not whether the cap assembly 14 moves relative to the sprinkler body 12 or whether the sprinkler body 12 moves relative to the cap assembly 14. In any event, the following description assumes that one holds the body 12 stationary and moves the cap assembly 14 both vertically and rotationally relative to the body. In addition, FIGS. 7–10 show only one of three wedge locks 66 (and one associated tab 36) and it will be appreciated that the description below applies to all of the wedge locks 66 and associated tabs 36.

Figure 7:
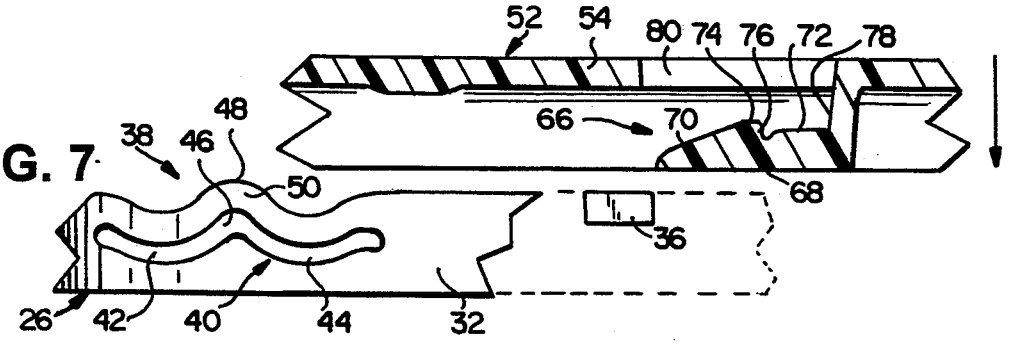
FIGS. 7 through 13 are partial section views illustrating, sequentially, the manner in which the cap cooperates with the sprinkler body during assembly and disassembly of the cap.
Figure 8:
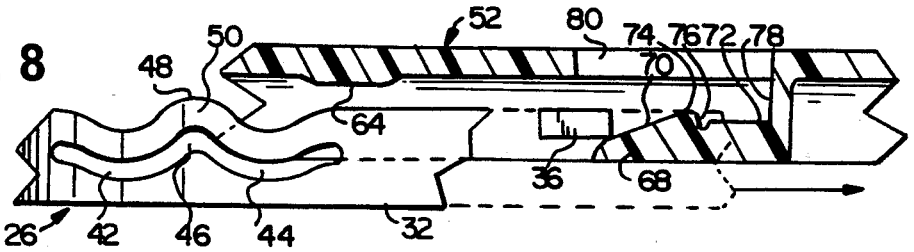
Figure 9:
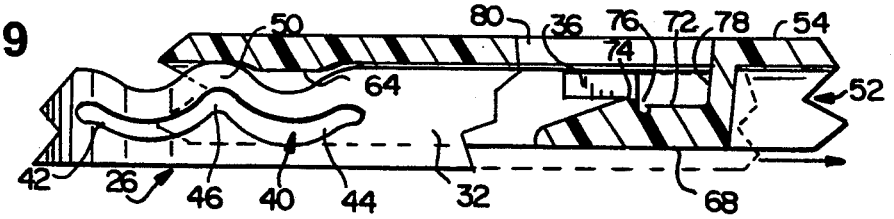
Figure 10:
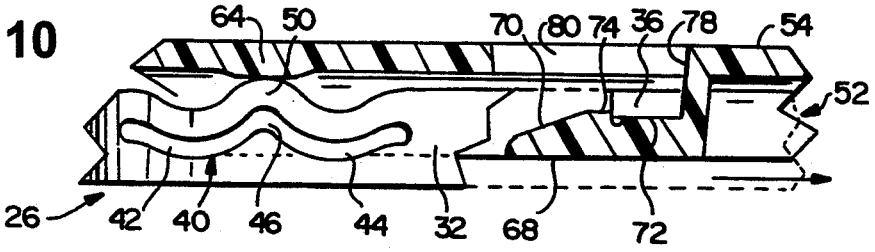

FIG. 7 illustrates the cap assembly 14 in a proper vertical registry with a sprinkler body 12 for purposes of assembly. Note in this regard that the cap assembly 14 is positioned for movement vertically downwardly relative to the sprinkler body 12, with the wedge lock 66 able to clear the tab 36 on the wall 34 of the body 12. After positioning the cap assembly onto the body 12 approximately as shown in FIG. 8, the cap assembly 14 is rotated in a clockwise direction, i.e., to the left as viewed in FIG. 8. As a result of this movement, the tabs 36 on the body 12 pull the cap assembly 14 downwardly by reason of the sliding engagement of the tabs 36 along the ramp surfaces 70. As the cap assembly 14 is pulled down, the projecting lugs 64 engage the raised center portions 48 of the resilient spring areas 38 to, in effect, resist downward movement of (and thereby exert an upward bias on) the cap assembly 14 relative to the body 12, as illustrated in FIG. 9. In FIG. 10, the cap assembly 14 is illustrated in its finally locked position, with the tabs 36 having seated themselves on the lands 72. Because the lands 72 are at a slightly lesser height than the uppermost edge of the wedge ramp surfaces 70, when the tabs 36 seat on the lands 72, some of the resistive spring force exerted by the resilient spring areas 38 on the cap assembly lugs 64 will be relieved. In this releasably locked position, the fully engaged seating between the tabs 36 and the lands 72 will prevent inadvertent or accidental disassembly of the cap assembly 14 from the sprinkler body 12.

Figure 11:
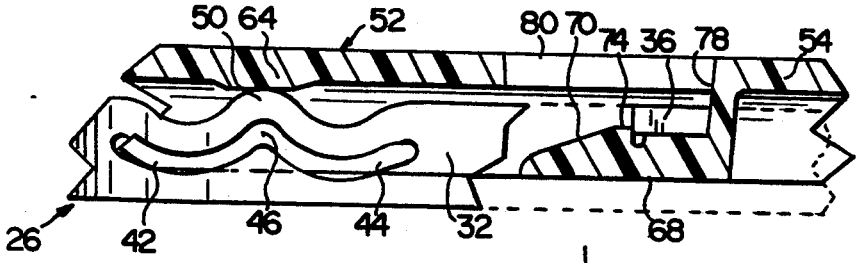
Figure 12:
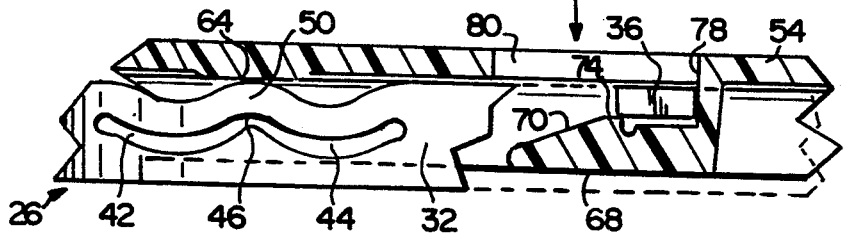
Figure 13:
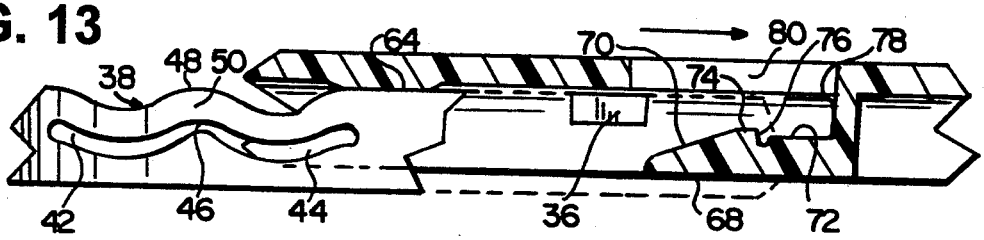

With respect new to FIGS. 11 through 13, a release sequence is illustrated to better enable an understanding of how the cap assembly 14 is removed from the sprinkler body 12. Beginning with the cap assembly 14 and sprinkler body 12 shown in the locked position in FIG. 11, the user simply presses downwardly on the cap assembly 14 relative to the body 12, against the bias of the resilient spring areas 38, so as to enable the tabs 36 to clear the lower shoulders 76 between the ramp surfaces 70 and the lands 72. This then enables the user to rotate the cap assembly 14 in a counterclockwise direction, i.e., to the right in FIG. 13, in order to move the wedge locks 66 to a location circumferentially spaced from the tabs 36. At the same time, the cap lugs 64 are also moved circumferentially to eliminate any spring forces otherwise exerted in the resilient spring areas 38. At this point, the user can simply lift the cap assembly 14 from the sprinkler body 12.

In the above described exemplary embodiment, preferably three wedge locks 66 are equally circumferentially spaced about the cap assembly 14, for interaction with three similarly spaced tabs on the sprinkler body 12,as best seen in FIGS. 3, 4 and 6. It will be appreciated, however, that fewer or greater numbers of latching devices and associated tabs may be employed.

Figure 14:
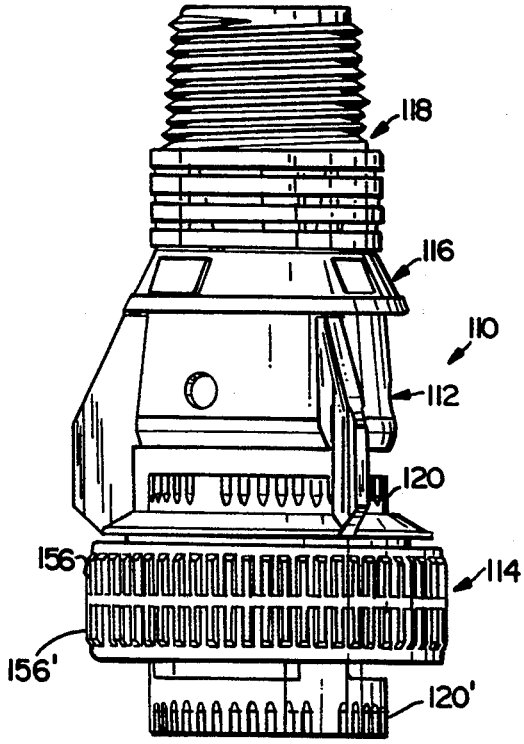
FIG. 14 is a side elevation of a modular sprinkler construction in accordance with an alternative embodiment of the invention.
Figure 15:
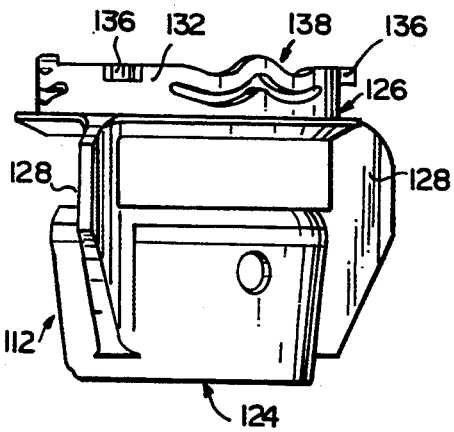
FIG. 15 is a side elevation of the sprinkler body portion of the sprinkler illustrated in FIG. 14, but shown in an upright orientation, and with other parts removed for clarity.
Figure 16:
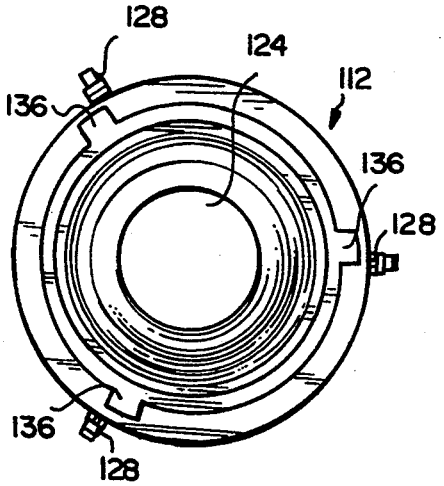
FIG. 16 is atop plan view of the sprinkler body portion illustrated in FIG. 15.
Figure 18:
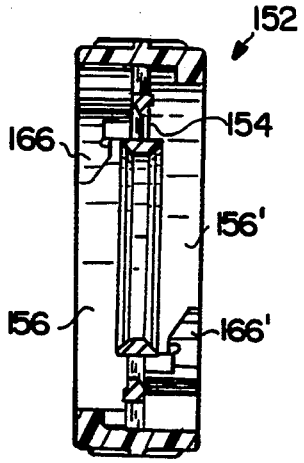
FIG. 18 is a side section through the cap illustrated in FIG. 17.
Figure 20:
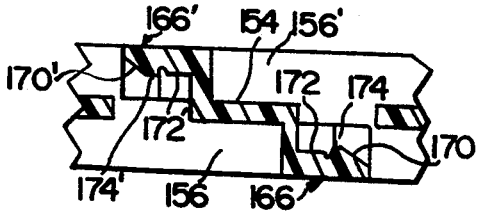
FIG. 20 is a partial section of the cap illustrated in FIGS. 17 through 19, illustrating the mirror image upper and lower positive latching mechanisms in accordance with the invention.

With reference now to FIGS. 14–16, the invention is illustrated in connection with another modular sprinkler 110. Similar reference numerals are used to designate corresponding components, but with the prefix "1" added. More specifically, the cap assembly 114 in this alternative embodiment is formed to permit the installation of distributor plates in the form of differently configured non-rotatable, fixed spray heads or plates 120, 120′ on either side of the cap assembly, thereby making the cap assembly "reversible". In other words, if it desired in change the sprinkling pattern, the user need only remove the cap assembly 114, invert it, and resecure it to the sprinkler body 112. To achieve this end, the cap skirt is formed with mirror image positive latching devices of the type described earlier, located on oppositely extending skirt portions 156, 156′. With specific reference to FIGS. 18 and 20, it may be seen that wedge locks 166, 166′ extend along upper and lower edges of the cap skirt portions 156, 156′, in opposite circumference directions, and that lugs 164, 164′ project from opposite sides of the top wall 154. It is this mirror image construction which allows the cap assembly to be inverted and then assembled to the sprinkler body 112 for interaction with tabs 136 in a substantially identical manner as described above.

Figure 17:
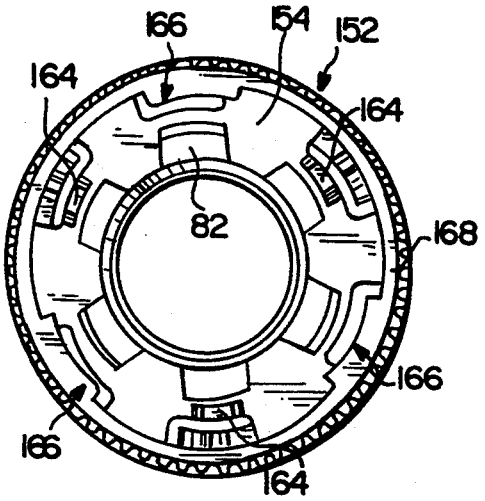
FIG. 17 is a bottom plan view of the sprinkler cap illustrated in FIG. 14, the bottom plan taken in reference to a cap in an upright orientation.
Figure 19:
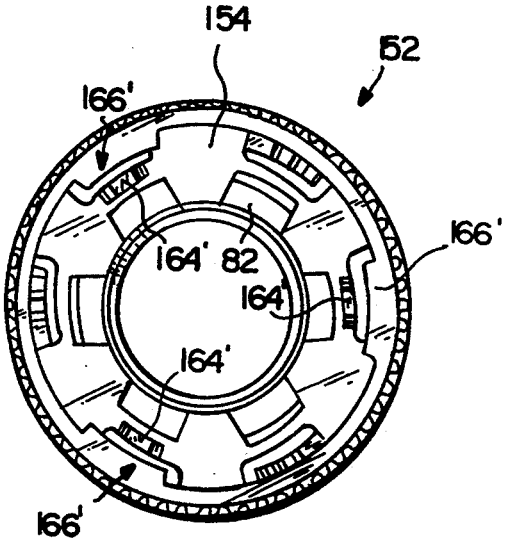
FIG. 19 is a top plan view of the cap illustrated in FIG. 17.
Figure 21:
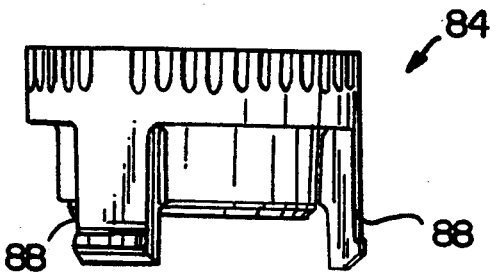
FIG. 21 is an inverted side elevation of a spray plate usable with the cap illustrated in FIGS. 17 through 20.
Figure 22:
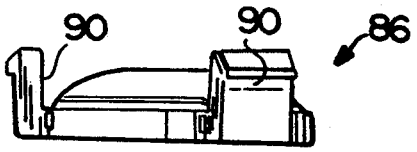
FIG. 22 is a side elevation of a spider wash plate usable with the cap assembly illustrated in FIGS. 17 through 20.

With further reference to the cap construction illustrated particularly in FIGS. 17 and 19, a plurality of apertures 82 are provided in the cap top wall 154 which are designed to receive selected spray heads 120, 120′. Specific examples of spray heads shown generally at 120, 120′ in FIG. 14 are shown in FIGS. 21 and 22 at 84 and 86, respectively. Each spray head 84, 86 is designed to provide a distinct sprinkling pattern, but each is provided with three identical mounting tabs 88, 90 (two shown in each Figure), respectively, which are adapted to engage three of the apertures 82 in the cap in a snap fit type arrangement. It will be appreciated that by providing six apertures 82 in the cap, and by providing three mounting tabs 88 and 90, respectively, on each of the spray heads, the cap is able to mount both spray heads 84, 86 from opposite sides of the top wall 154, with alternating ones of the apertures 86 receiving the mounting tabs 88 or 90 of a respective spray head. Otherwise, as can be seen from FIG. 15, the sprinkler body itself is substantially similar to the sprinkler body illustrated in FIG. 2, and the interaction between the cap assembly (from either side) with the sprinkler body mounting ring 126 remains as previously described.

While the invention has been described in connection with what it presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A modular sprinkler assembly comprising:

a sprinkler body including an annular cap supporting ring and a nozzle for emitting a liquid stream to atmosphere, and a cap assembly removably secured to said cap supporting ring, said cap assembly including a cap supporting a stream distributor, said cap having a top wall and an annular depending skirt, an interior surface of said skirt having at least one latch device formed thereon, said latch device including a wedge-shaped surface portion and a land portion, and wherein said cap supporting ring has at least one radially extending tab adapted to ride on said wedge-shaped surface portion and to seat on said land portion upon rotation of said cap relative to said sprinkler body and further wherein said cap supporting ring is formed with a plurality of circumferentially spaced resilient spring portions configured so as to oppose movement of said tab onto said land.

2. The modular sprinkler of claim 1 wherein said circumferentially spaced, resilient spring portions are each formed by an elongated slot formed in said cap supporting ring adjacent a locally raised upper edge portion thereof.

3. The modular sprinkler of claim 2 wherein said cap top wall includes a plurality of lugs on an underside thereof, each said lug adapted to engage a respective one of said locally raised edge portions when said at least one tab is seated on said at least one land.

4. The modular sprinkler of claim 1 wherein said nozzle is fixed and said stream distributor is rotatable about a longitudinal axis of the sprinkler.

5. The modular sprinkler of claim 4 wherein said stream distributor is controlled by a viscous fluid dampener.

6. The modular sprinkler of claim 1 wherein said nozzle and said stream distributor are fixed.

7. The modular sprinkler of claim 1 wherein said land lies below and adjacent an uppermost edge of said wedge-shaped surface portion.

8. A modular sprinkler assembly comprising a sprinkler body having a nozzle therein for emitting a stream in a direction substantially coincident with a longitudinal axis of said sprinkler body, said sprinkler body also having a supporting ring located downstream of said nozzle; and a cap assembly removably secured on said mounting ring, said cap assembly including a cap having a top wall and a depending skirt, said top wall supporting at least one stream distributor in proximity to said nozzle; said mounting ring and said cap having first and second means, respectively, for removably securing said cap assembly to said mounting ring, said second means including at least one wedge lock extending partially about said mounting ring, said wedge lock including a wedge surface and an adjacent land for cooperating engagement with said first means, and wherein said second means further comprises a plurality of downwardly projecting lugs formed on an underside of said top wall.

9. The modular sprinkler of claim 8 wherein said first means comprises at least one tab extending radially outwardly from an upper edge of said mounting ring.

10. The modular sprinkler of claim 9 wherein said first means comprises a plurality of said tabs and said second means comprises a corresponding plurality of said wedge locks.

11. The modular assembly of claim 10 wherein each of said tabs is adapted to slide on a corresponding wedge surface and to seat on a corresponding land upon placement of said cap assembly on said mounting ring and further upon relative rotation between said cap assembly and said supporting ring.

12. The modular sprinkler of claim 8 wherein said supporting ring is formed with a plurality of resilient spring areas for cooperative engagement with said plurality of lugs.

13. The modular sprinkler assembly of claim 12 wherein said circumferentially spaced, resilient spring areas are each formed by an elongated slot formed in said cap supporting ring adjacent a locally raised upper edge portion thereof.

14. The modular sprinkler of claim 8 wherein said at least one stream distributor is rotatable.

15. The modular sprinkler of claim 8 wherein said depending skirt portion extends in one direction from said top wall, and wherein an upper skirt portion extends in an opposite direction from said top wall, and wherein said upper skirt portion is also provided with at least one of said wedge locks to thereby provide a reversible cap assembly.

16. The modular sprinkler of claim 15 wherein a pair of different configured, non-rotatable stream distributors are secured on opposite sides of said top wall.

17. A modular sprinkler assembly comprising:

a sprinkler body including a substantially vertical annular cap supporting ring and a nozzle for emitting a liquid stream to atmosphere; and a reversible cap assembly removably secured to said cap supporting ring, said cap assembly having a top wall common to upper and lower skirt portions extending in opposite directions from said top wall, said upper and lower skirt portions each having at least one latch device for selective cooperation with at least one cooperating tab on said cap supporting ring, said at least one latch device including a wedge-shaped surface portion and a land portion, and wherein said cap supporting ring has at least one radially extending tab adapted to ride on said wedge-shaped surface portion and to seat on said land portion upon rotation of said cap relative to said sprinkler body, and further wherein said cap supporting ring is formed with a plurality of circumferentially spaced resilient spring portions configured so as to opposite movement of said tab onto said land.

18. A modular sprinkler assembly comprising:

a sprinkler body including a substantially vertical annular cap supporting ring and a nozzle for emitting a liquid stream to atmosphere; and a reversible cap assembly removably secured to said cap supporting ring, said cap assembly having a top wall common to upper and lower skirt portions extending in opposite directions from said top wall, said upper and lower skirt portions each having at least one latch device for selective cooperation with at least one cooperating tab on said cap supporting ring, wherein said first and second stream distributors each have a plurality of mounting tabs and said top wall is provided with sufficient mounting tab receiving apertures to accommodate both said first and second stream distributors.

* * * * *